US010975780B2

(12) United States Patent
Wishin et al.

(10) Patent No.: US 10,975,780 B2
(45) Date of Patent: Apr. 13, 2021

(54) SPEED LIMITING SYSTEM AND METHOD

(71) Applicant: Honda Motor Co., Ltd., Tokyo (JP)

(72) Inventors: David J. Wishin, Marysville, OH (US); Kevin Stockmeier, Marysville, OH (US)

(73) Assignee: Honda Motor Co., Ltd., Tokyo (JP)

( * ) Notice: Subject to any disclaimer, the term of this patent is extended or adjusted under 35 U.S.C. 154(b) by 112 days.

(21) Appl. No.: 16/407,511

(22) Filed: May 9, 2019

(65) Prior Publication Data

US 2020/0355129 A1 Nov. 12, 2020

(51) Int. Cl.
*F02D 31/00* (2006.01)

(52) U.S. Cl.
CPC ..... *F02D 31/001* (2013.01); *F02D 2400/22* (2013.01)

(58) Field of Classification Search
CPC ..... B60K 31/00; B60K 2031/0091
See application file for complete search history.

(56) References Cited

U.S. PATENT DOCUMENTS

| | | | | |
|---|---|---|---|---|
| 4,740,898 | A | 4/1988 | Mckee | |
| 7,084,735 | B2 | 8/2006 | Kapolka | |
| 7,530,345 | B1 | 5/2009 | Plante | |
| 8,219,270 | B2 * | 7/2012 | Lenart | B60L 7/24 701/22 |
| 9,286,264 | B2 * | 3/2016 | Johnson | G06F 17/00 |
| 9,550,418 | B1 | 1/2017 | Logan et al. | |
| 9,889,849 | B2 | 2/2018 | Nakade | |
| 10,053,094 | B2 | 8/2018 | Mukkala, II et al. | |
| 2004/0030483 | A1 | 2/2004 | Muehlbauer | |
| 2004/0199322 | A1 * | 10/2004 | Olsen | F02P 5/06 701/93 |
| 2011/0060506 | A1 * | 3/2011 | Harden | B60N 2/0228 701/49 |
| 2013/0345914 | A1 * | 12/2013 | Love | B60W 10/08 701/22 |
| 2018/0079410 | A1 | 3/2018 | Yamashita et al. | |

FOREIGN PATENT DOCUMENTS

| | | | |
|---|---|---|---|
| CN | 201525292 | U | 7/2010 |
| CN | 105459823 | B | 4/2016 |
| WO | 2008082403 | A1 | 7/2008 |

* cited by examiner

*Primary Examiner* — Sizo B Vilakazi
(74) *Attorney, Agent, or Firm* — American Honda Motor Co., Inc.; Mark E. Duell

(57) ABSTRACT

A system and method for limiting a speed of a vehicle is disclosed. The vehicle includes an ECU in communication with and configured to control the engine. The ECU has a plurality of pins, a jumper plug connected to the plurality of pins, and a cap selected from a group of caps, each of which is configured to create a different limit circuit when installed on the jumper plug. The ECU is configured to limit the speed of the vehicle to a predetermined speed when the limit circuit is detected by the ECU based on the detected cap. The ECU, jumper plug, and cap are covered by a cover secured to the frame of the vehicle by fasteners that require a tool to remove.

15 Claims, 7 Drawing Sheets

28

| CAP | VMAX SPEED LIMIT REQUIREMENT | ECU WHEN ACTIVE (24b) | ECU WHEN NOT ACTIVE (24c) | VEHICLE SPEED LIMIT SET |
|---|---|---|---|---|
| | | ECU PIN "X" | ECU PIN "Y" | VMAX ← " " |
| GREEN | 38 MPH | 5V | OPEN | VMAXGR (GR = GREEN) |
| BLUE | 30 MPH | OPEN | 5V | VMAXBL (BL = BLUE) |
| YELLOW | 20 MPH | OPEN | OPEN | VMAXYE (YE = YELLOW) |
| N/A ERROR STATE | 20 MPH (NO NEED TO GO LOWER) | 5V | 5V | ERROR STATE, SET LOWEST SPEED LIMIT. |

FIG. 8

SPEED LIMITING SYSTEM AND METHOD

TECHNICAL FIELD

The embodiments described herein relate to the field of limiting the speed of a vehicle, and more specifically to setting the speed limit of a vehicle.

BACKGROUND

Vehicles of the type typically described as all-terrain vehicles, or ATVs, may be required to be equipped with a system and method for limiting throttle travel or other systems and methods for limiting the maximum speed of the vehicle to either 20 mph (32 km/h) and 30 mph (48 km/h) when tested. The vehicle may further be required to prevent adjustment or removal of the speed limiting system and method without the use of tools or other specialized devices.

In order to limit speed of the vehicle, an electronic control unit ("ECU") may be programmed to limit the throttle of the vehicle, or the ECU may be programmed to limit a governor on the engine using methods well known to those skilled in the art. However, the problem posed by the requirements recited is how to change the programming of the ECU to provide varying limits that requires the use of tools or specialized devices to remove the limits or make changes.

APPLICATION SUMMARY

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

According to one aspect, a system for limiting a speed of a vehicle, the vehicle having a frame, a body attached to the frame, an engine attached to the frame, and at least one wheel affixed to the frame and driven by the engine, includes an electronic control unit (ECU) in communication with and configured to control the engine, the ECU having a plurality of pins, a jumper plug connected to the plurality of pins of the ECU, and a first cap configured to create a first circuit when installed on the jumper plug, the ECU configured to limit the speed of the vehicle to a first speed when the first circuit is detected by the ECU.

According to another aspect, a system for limiting a speed of a vehicle, the vehicle having a frame, a body attached to the frame, an engine attached to the frame, and at least one wheel affixed to the frame and driven by the engine, includes an ECU in communication with and configured to control the engine, the ECU having a plurality of pins, a jumper plug connected to the plurality of pins of the ECU, and a cap configured to create a limit circuit when installed on the jumper plug, the ECU configured to limit the speed of the vehicle to a predetermined speed when the limit circuit is detected by the ECU.

According to yet another aspect, a method for limiting a speed of a vehicle, the vehicle having a frame, a body attached to the frame, an engine attached to the frame, at least one wheel affixed to the frame and driven by the engine, and an ECU in communication with and configured to control the engine, the ECU having at least three pins, includes the steps of providing a jumper plug connected to the at least three pins of the ECU, installing a cap configured to create a limit circuit when installed on the jumper plug between two of the at least three pins including a first pin, a second pin, and a third pin, supplying a voltage to the first pin of the ECU connected to the jumper plug, checking a voltage at the second pin of the ECU, checking a voltage at the third pin of the ECU, and limiting the speed of the vehicle to a predetermined speed when a limit circuit is detected by the ECU based upon the voltage of the second pin and the third pin.

BRIEF DESCRIPTION OF THE DRAWINGS

FIG. 8 is a table illustrating operation of the ECU to limit speed of the vehicle of FIG. 1.

The figures depict various embodiments for purposes of illustration only. One skilled in the art will readily recognize from the following discussion that alternative embodiments of the structures and methods illustrated herein may be employed without departing from the principles of the embodiments described herein.

DETAILED DESCRIPTION

Figure 1:
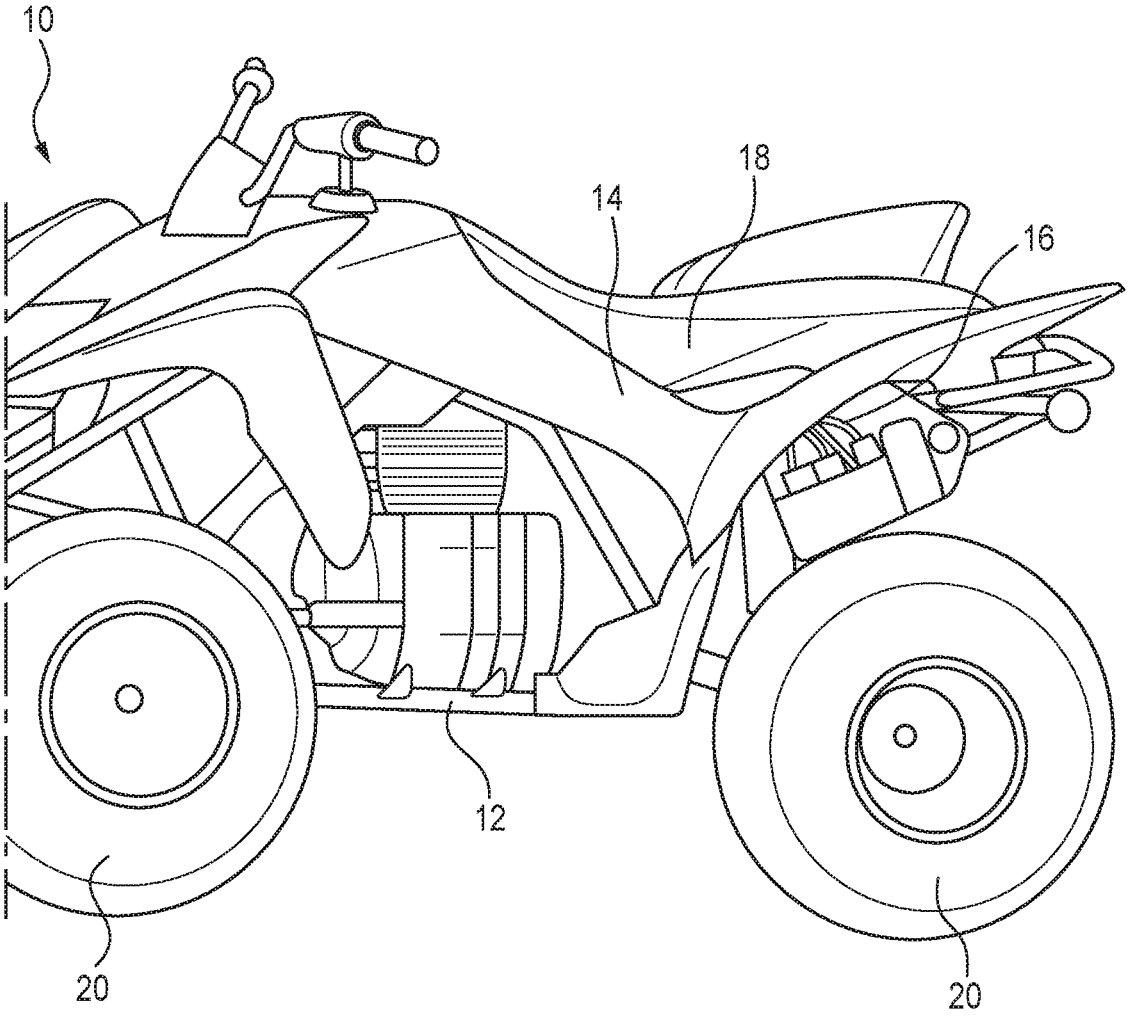
FIG. 1 is a side view of a vehicle typically described as an all-terrain vehicle ("ATV").

FIG. 1 is a side view of a vehicle 10 of the type typically described as an all-terrain vehicle ("ATV"). The vehicle 10 includes a frame 12, a body 14 on the frame 12, an engine 16 that is located on the frame 12 beneath a seat 18 on which a rider (not shown) sits, and three or four wheels 20, the rear wheels 20 being driven by the engine 16. The vehicle 10 may also include an electronic control unit ("ECU") 22, illustrated in FIGS. 2-3, for controlling operation of the engine 16.

The vehicle 10 may be required to be equipped with a system and method for limiting throttle travel or other system and methods for limiting the maximum speed of the vehicle 10 to 20 mph (32 km/h) and/or 30 mph (48 km/h) when tested. The vehicle 10 may further be required to prevent adjustment or removal of the speed limiting system and method without the use of tools or other specialized devices.

In order to limit speed of the vehicle 10, the ECU 22 may be programmed to limit the throttle of the vehicle 10, or the ECU may be programmed to limit a governor (not shown) on the engine 16 using methods well known to those skilled in the art. However, the problem posed by the requirements recited is how to change the programming of the ECU 22 to provide varying limits that requires the use of tools or specialized devices to remove the limits or make changes.

Figure 2:
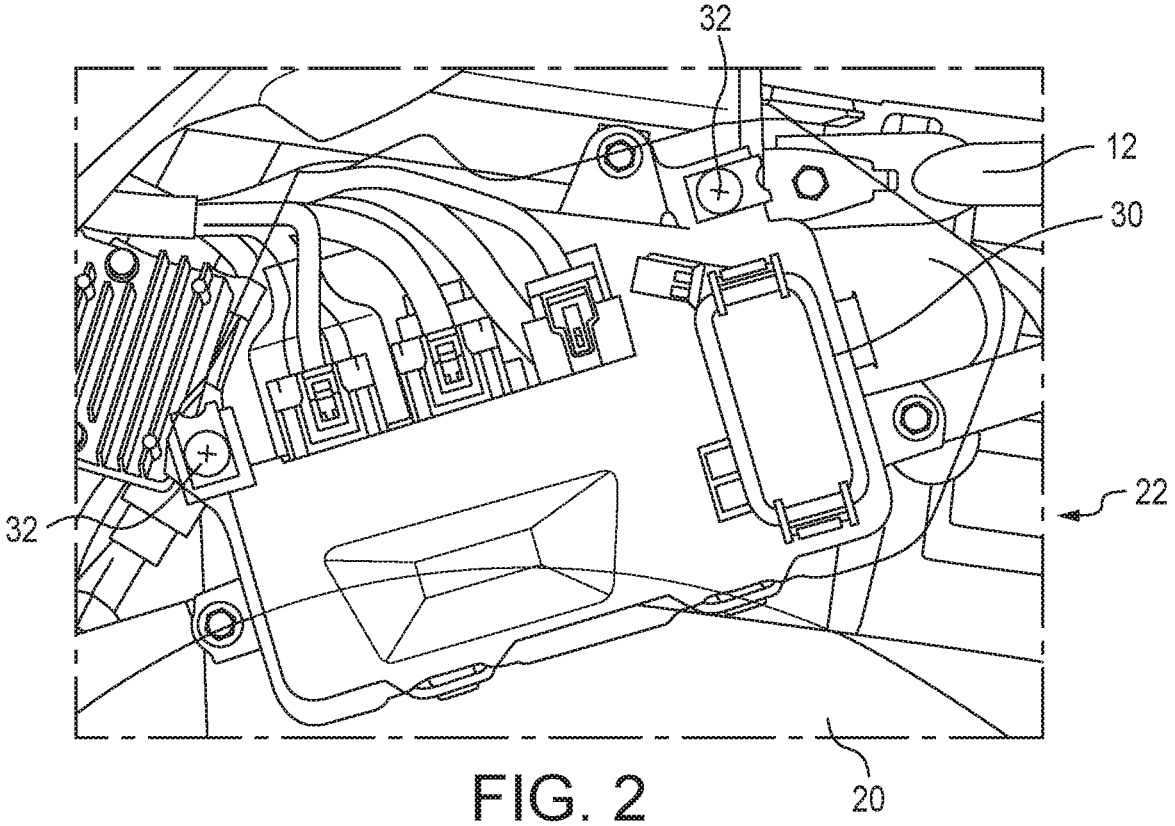
FIG. 2 is a side view of an electronic control unit ("ECU") of the vehicle of FIG. 1 with a cover installed.
Figure 3:
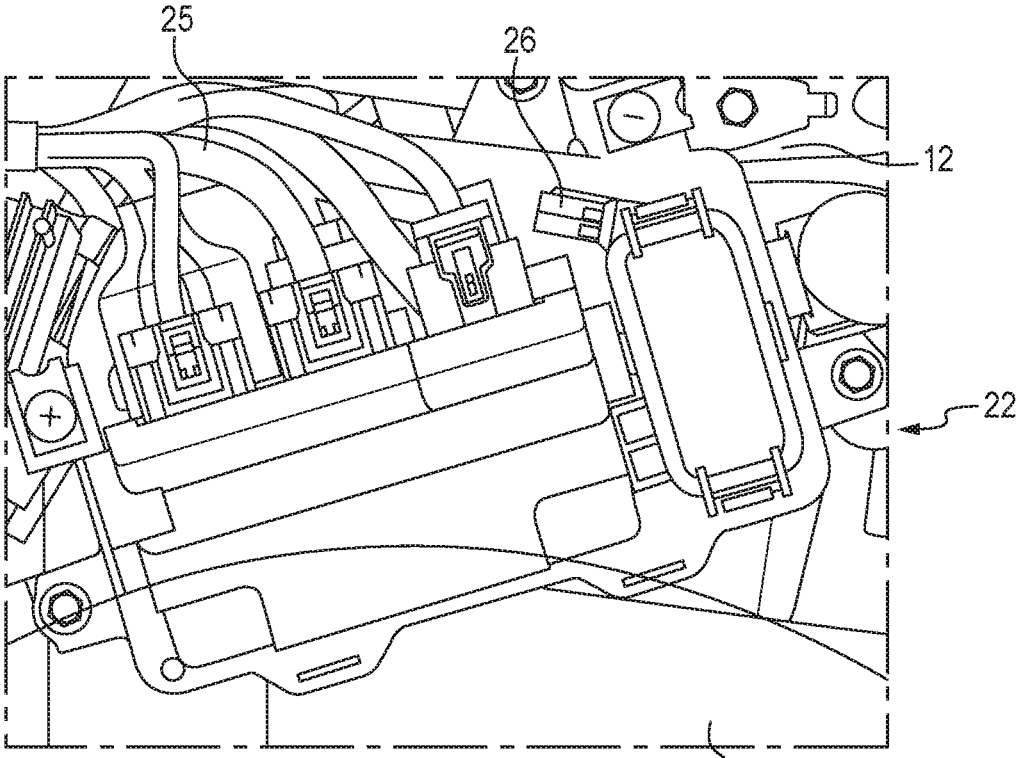
FIG. 3 is a side view of the ECU of the vehicle of FIG. 1 with the cover removed.
Figure 4:
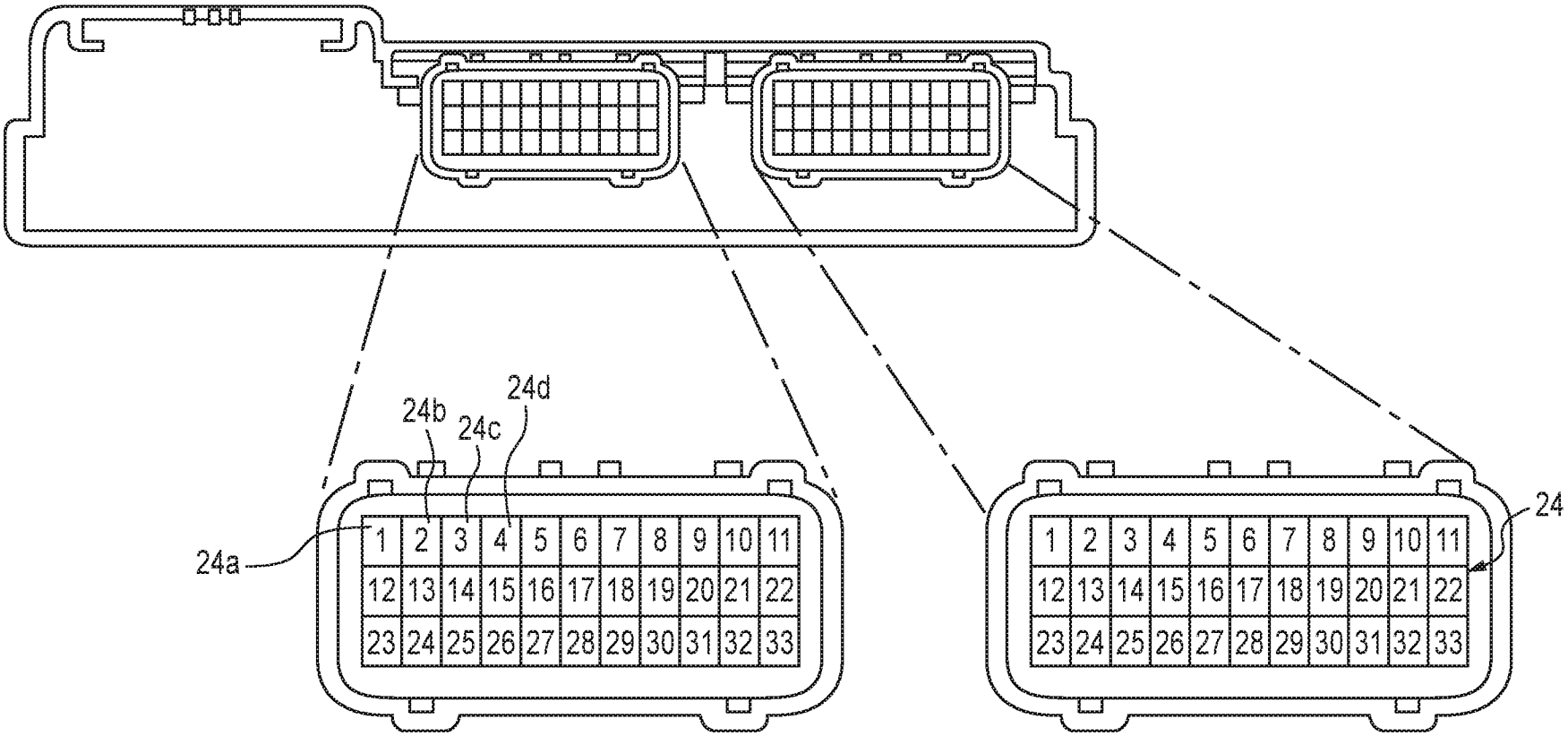
FIG. 4 is a schematic view of the pins of the ECU of FIGS. 2 and 3.
Figure 5:
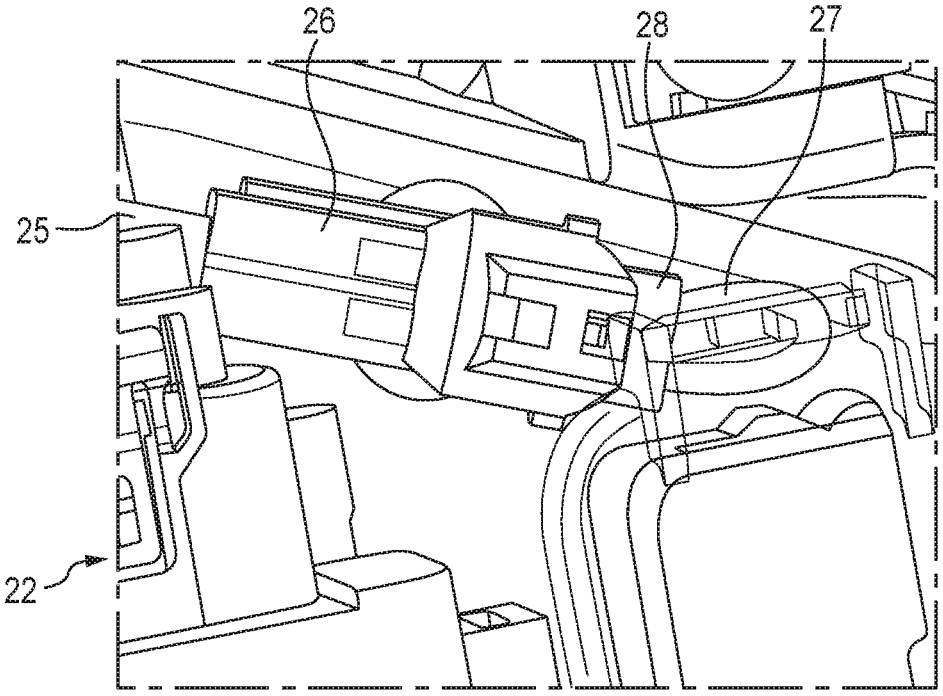
FIG. 5 is a side view of a jumper plug and cap associated with the ECU of FIGS. 2 and 3.
Figure 6:
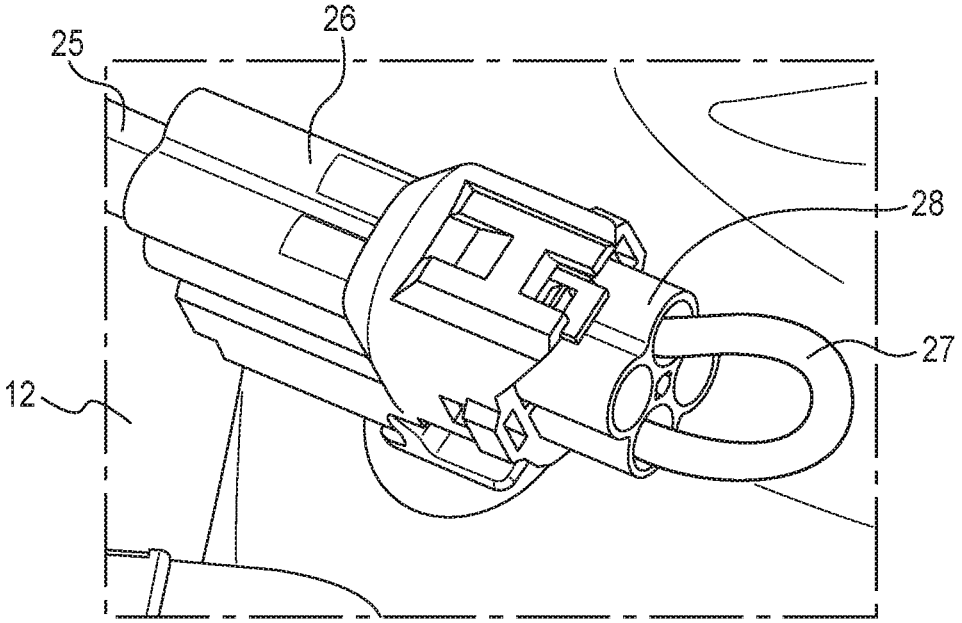
FIG. 6 is a side perspective view of the jumper plug and cap of FIG. 5.

In a system for limiting the speed of the vehicle 10, illustrated in FIGS. 2-6, the ECU 22 includes a plurality of pins 24, schematically illustrated in FIG. 4. Referring again to FIG. 3, a jumper plug 26 is connected to a number of the plurality of pins 24 of the ECU 22 via plug connected to a wire harness 25, into which the jumper plug 26 is attached. One of the pins 24, which is voltage pin 24*a*, is configured to supply a voltage V, such as a 5V signal in one embodiment or a 12V signal in another embodiment. The remaining pins 24*b*, 24*c*, 24*d* are configured to be in communication with the jumper plug 26, most commonly as a 4-pin arrangement, although 3-pin, 6-pin, and other variations are possible, are present to read the voltage V when a cap 28, with a wire 27 connecting two of the pins 24, is attached to complete a circuit between the voltage pin 24*a* and one of the remaining pins 24*b*, 24*c*, 24*d*.

In an alternate embodiment, the jumper plug 26 may be attached to a controller area network (CAN) bus, with the CAN bus acting as the connection between the jumper plug 26 and the ECU 22.

In the embodiment illustrated in FIG. 2, the ECU 22, jumper plug 26, and cap 28 are covered by a cover 30. The cover 30 is attached to the frame 12 of the vehicle 10 by at least one fastener 32 that requires a tool (not shown) to be removed. The fasteners 32 may be screws that requires a screwdriver or associated tool to remove, bolts that require a wrench to remove, or any other type of fastener that requires a tool to remove.

Figure 7A:
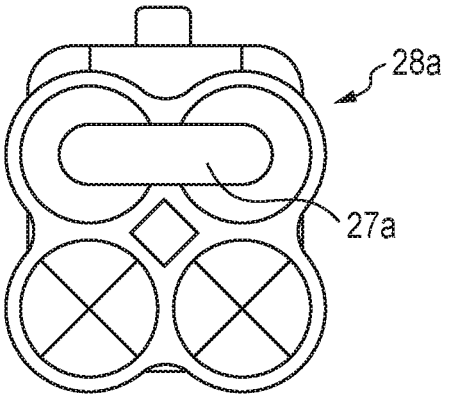
FIGS. 7A, 7B, and 7C are top views of embodiments of the cap for the jumper plug of FIG. 5.

Moving to operation of the system, a first cap 28*a*, as illustrated in FIG. 7A is configured to create a first circuit when installed on the jumper plug 26. In the case of the first cap 28*a*, a wire 27*a* runs to close the first circuit between the voltage pin 24*a* and a pin "x" 24*b*. In this case, further illustrated in the table FIG. 8, the ECU 22 reads a 5 V voltage at pin "x" 24*b*, and reads an open circuit (i.e. reads 0 V) at pin "y" 24*c*. The ECU 22 is configured and programmed to limit the speed of the vehicle 10 to a first speed $V_{MAX/GR}$ when the first circuit is detected by the ECU 22. In the embodiment illustrated, the first speed $V_{MAX/GR}$ is programmed to be 38 mph. In order to differentiate the first cap 28*a*, the first cap 28*a* and/or the wire 27*a* may be colored, in this case green.

Figure 7B:
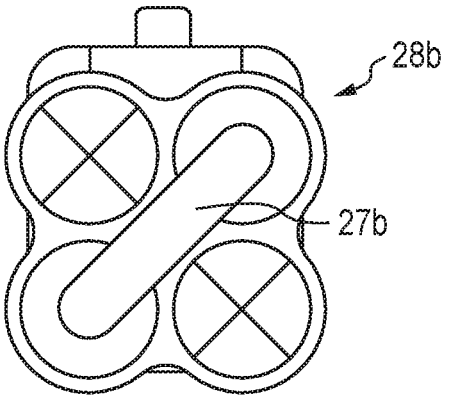

A second cap 28*b*, as illustrated in FIG. 7B is configured to create a second circuit when installed on the jumper plug 26. In the case of the second cap 28*b*, a wire 27*b* runs to close the second circuit between the voltage pin 24*a* and a pin "y" 24*c*. In this case, further illustrated in the table FIG. 8, the ECU 22 reads a 5 V voltage at pin "y" 24*c*, and reads an open circuit (reading 0 V) at pin "x" 24*b*. The ECU 22 is configured and programmed to limit the speed of the vehicle 10 to a second speed $V_{MAX/BL}$ when the second circuit is detected by the ECU 22. In the embodiment illustrated, the second speed $V_{MAX/BL}$ is programmed to be 30 mph. In order to differentiate the second cap 28*b* from the first cap 28*a*, the second cap 28*b* and/or the wire 27*b* may be alternatively colored, in this case blue.

Figure 7C:
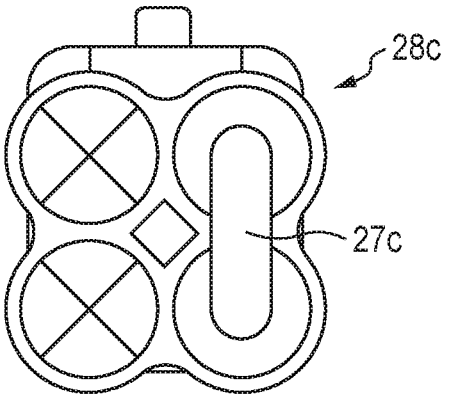

A third cap 28*c*, as illustrated in FIG. 7C, is configured to create a third circuit when installed on the jumper plug 26. In the case of the third cap 28*c*, a wire 26*c* runs to close the third circuit between the voltage pin 24*a* and a ground pin 24*c*. In this case, further illustrated in the table FIG. 8, the ECU reads an open circuit (reading 0 V) at pin "y" 24*c*, and reads an open circuit (reading 0 V) at pin "x" 24*b*. The ECU 22 is configured and programmed to limit the speed of the vehicle 10 to a third speed $V_{MAX/YE}$ when the third circuit is detected by the ECU 22. In the embodiment illustrated, the third speed $V_{MAX/YE}$ is programmed to be 20 mph. In order to differentiate the third cap 28*c* from the first cap 28*a* and the second cap 28*b*, the third cap 28*c* and/or the wire 27*c* may be alternatively colored, in this case yellow.

In an alternate embodiment, in the case of the third cap 28*c*, a wire 26*c* runs to close the third circuit between the voltage pin 24*a* and a pin "z" 24*d*, with the ECU 22 positively reading an open circuit (reading 0 V) at pin "y" 24*c*, an open circuit (reading 0 V) at pin "x" 24*b*, and a closed circuit (reading 5 V) at pin "z" 24*d*. The ECU 22 is configured and programmed to limit the speed of the vehicle 10 to a third speed $V_{MAX/YE}$ when the third circuit is detected by the ECU 22. In the embodiment illustrated, the third speed $V_{MAX/YE}$ is programmed to be 20 mph.

As illustrated in FIG. 8, an error or failsafe state may also exist. If the ECU 22 reads that both the first circuit and second circuit are open (reading 5 V), the ECU 22 may be programmed to deem an error state exists and to limit the speed of the vehicle 10 to the third speed $V_{MAX/YE}$. In the embodiment illustrated, the third speed $V_{MAX/YE}$ is programmed to be 20 mph.

Figure 9:
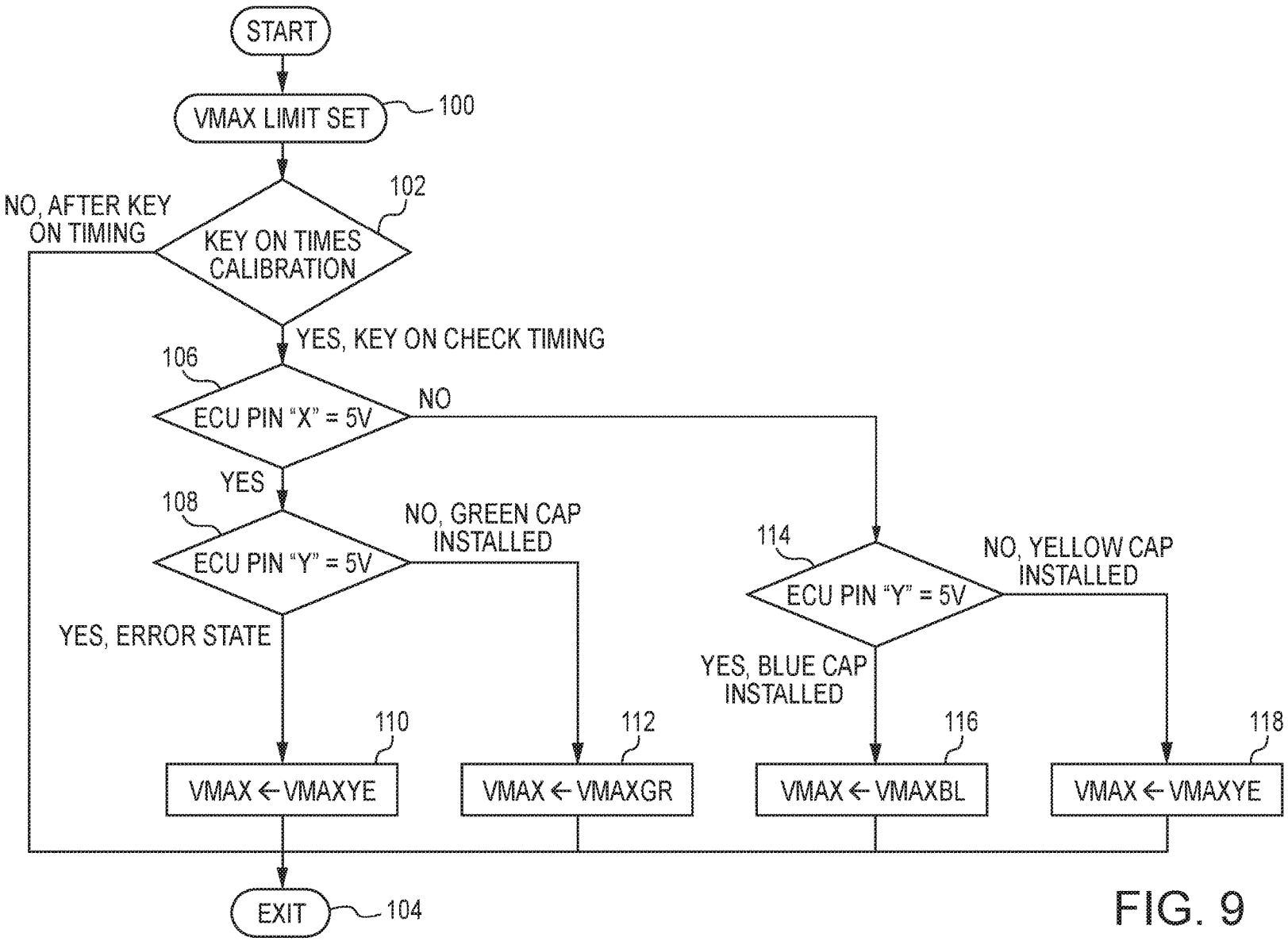
FIG. 9 is a flowchart illustrating a method of operating the ECU to detect which of the speed limit caps illustrated in FIGS. 7A-7C is installed on the jumper plug.

FIG. 9 illustrates a method of operation of the ECU 22 in for limiting a speed of the vehicle 10. In the first step 100, the maximum speed VMAX is selected by installing a cap configured to create a limit circuit when installed on the jumper plug between the voltage pin 24*a* and one of the remaining pins 24*b*, 24*c*, 24*d*. In the second step 102, the ECU determines if the cap is to be checked. If no, the ECU exits the method 104. If yes, a voltage is supplied to the voltage pin 24*a* and the first pin, pin "x" 24*b*, of the ECU 22 connected to the jumper plug 26 is checked 106. If the first pin, pix "x" 24*b*, is detected to be at 5 V, the second pin, pin "y" 24*c*, is checked 108 to determine if the error state is present. If the second pin, pin "y" 24*c*, also reads 5 V, the error state is detected and the third speed VMAX/YE is set as the maximum speed VMAX of the vehicle 10. If the second pin, pin "y" 24*c*, reads 0 V, the first cap 28*a*, which is in the embodiment illustrated green, is determined to be present, and the first speed VMAX/GR is set as the maximum speed VMAX of the vehicle 10 in step 112.

If the first pin, pin "x" 24*b*, does not read 5V (i.e. it reads 0 V), the method moves along to the next step 114 and checks the voltage at the second pin, pin "y" 24*c*, of the ECU 22. If the second pin, pin "y" 24*c*, reads 5 V, it is determined that the second cap 28*b*, which in the illustrated embodiment is blue, is installed. In the next step 116, the maximum speed $V_{MAX}$ is set at the second speed $V_{MAX/BL}$.

If the second pin, pin "y" 24*c*, does not read 5 V (i.e. reads 0 V), the third cap 28*c*, which is in the embodiment illustrated yellow, is determined to be installed, and the third speed $V_{MAX/YE}$ is set as the maximum speed $V_{MAX}$ of the vehicle 10 in step 118.

Alternatively, the ECU 22 may check for a voltage at the third pin, pin "z" 24*d*, of the ECU 22, and set the third speed $V_{MAX/YE}$ to be the maximum speed $V_{MAX}$ of the vehicle 10 if the third pin 24*d* reads 5 V.

Reference in the specification to "one embodiment" or to "an embodiment" means that a particular feature, structure, or characteristic described in connection with the embodiments is included in at least one embodiment. The appearances of the phrase "in one embodiment" or "an embodiment" in various places in the specification are not necessarily all referring to the same embodiment.

In addition, the language used in the specification has been principally selected for readability and instructional purposes, and may not have been selected to delineate or circumscribe the inventive subject matter. Accordingly, the disclosure of the embodiments is intended to be illustrative, but not limiting, of the scope of the embodiments, which is set forth in the claims.

While particular embodiments and applications have been illustrated and described herein, it is to be understood that the embodiments are not limited to the precise construction and components disclosed herein and that various modifications, changes, and variations may be made in the arrangement, operation, and details of the methods and apparatuses of the embodiments without departing from the spirit and scope of the embodiments as defined in the appended claims.

What is claimed is:

1. A system for limiting a speed of a vehicle, the vehicle having a frame, a body attached to the frame, an engine attached to the frame, and at least one wheel affixed to the frame and driven by the engine, comprising:

an electronic control unit (ECU) in communication with and configured to control the engine, the ECU having a plurality of pins;

a jumper plug connected to the plurality of pins of the ECU;

a first cap configured to create a first circuit when installed on the jumper plug, the ECU configured to limit the speed of the vehicle to a first speed when the first circuit is detected by the ECU; and a second cap configured to create a second circuit when installed on the jumper plug, the ECU configured to limit the speed of the vehicle to a second speed when the second circuit is detected by the ECU.

2. The system of claim 1 further comprising:

a third cap configured to create a third circuit when installed on the jumper plug, the ECU configured to limit the speed of the vehicle to a third speed when the third circuit is detected by the ECU.

3. The system of claim 1 further comprising:

a wire harness, the ECU and the jumper plug being connected to the wire harness;

a cover configured to cover the ECU and the jumper plug; and at least one fastener attaching the cover to the wire harness.

4. The system of claim 3 wherein the at least one fastener is selected from a group consisting of a screw and a bolt.

5. The system of claim 4 further comprising:

a controller area network (CAN) bus, wherein the jumper plug is connected to ECU by the CAN bus.

6. A system for limiting a speed of a vehicle, the vehicle having a frame, a body attached to the frame, an engine attached to the frame, and at least one wheel affixed to the frame and driven by the engine, comprising:

an electronic control unit (ECU) in communication with and configured to control the engine, the ECU having a plurality of pins;

a jumper plug connected to the plurality of pins of the ECU;

a cap configured to create a limit circuit when installed on the jumper plug, the ECU configured to limit the speed of the vehicle to a predetermined speed when the limit circuit is detected by the ECU;

wherein the cap is selected from a group consisting of first cap, a second cap, and a third cap;

wherein the first cap is configured to create a first circuit when installed on the jumper plug, the ECU being configured to limit the speed of the vehicle to a first speed when the first circuit is detected by the ECU; and wherein the second cap is configured to create a second circuit when installed on the jumper plug, the ECU being configured to limit the speed of the vehicle to a second speed when the second circuit is detected by the ECU.

7. The system of claim 6 wherein the first speed is 38 miles per hour.

8. The system of claim 7 wherein the second speed is 30 miles per hour.

9. The system of claim 8 wherein the third cap is configured to create a third circuit when installed on the jumper plug, the ECU being configured to limit the speed of the vehicle to a third speed when the third circuit is detected by the ECU.

10. The system of claim 9 wherein the third speed is 20 miles per hour.

11. The system of claim 6 further comprising:

a wire harness, the ECU and the jumper plug being connected to the wire harness;

a cover configured to cover the ECU and the jumper plug; and at least one fastener attaching the cover to the wire harness.

12. The system of claim 6 wherein the first cap, the second cap, and the third cap are color-coded for identification.

13. The system of claim 6 wherein the ECU defaults to a default speed if the limit circuit is not detected.

14. A method for limiting a speed of a vehicle, the vehicle having a frame, a body attached to the frame, an engine attached to the frame, at least one wheel affixed to the frame and driven by the engine, and an electronic control unit (ECU) in communication with and configured to control the engine, the ECU having at least three pins, comprising the steps of:

providing a jumper plug connected to the at least three pins of the ECU;

installing a cap configured to create a limit circuit when installed on the jumper plug between two of the at least three pins including a first pin, a second pin, and a third pin;

supplying a voltage to the first pin of the ECU connected to the jumper plug;

checking a voltage at the second pin of the ECU;

checking a voltage at the third pin of the ECU;

limiting the speed of the vehicle to a predetermined speed when a limit circuit is detected by the ECU based upon the voltage of the second pin and the third pin;

removing the cap from the jumper plug;

installing a second cap to select a second predetermined speed;

supplying a voltage to the first pin of the ECU connected to the jumper plug;

checking a voltage at the second pin of the ECU;

checking a voltage at the third pin of the ECU; and limiting the speed of the vehicle to the second predetermined speed when a second limit circuit is detected by the ECU based upon the voltage of the second pin and the third pin.

15. The method of claim 14 further comprising the step of:

defaulting to a default predetermined speed if the voltage at the second pin and the voltage at the third pin are both zero; and defaulting to the default predetermined speed if the voltage at the second pin and the voltage at the third pin are both nonzero.

* * * * *